US011851851B2

(12) United States Patent
Arshad et al.

(10) Patent No.: US 11,851,851 B2
(45) Date of Patent: Dec. 26, 2023

(54) WORKING MACHINE HAVING AN ATTACHMENT DEVICE AND A SYSTEM FOR MONITORING ATTACHMENT STATUS OF AN ATTACHMENT DEVICE

(71) Applicant: Volvo Construction Equipment AB, Eskilstuna (SE)

(72) Inventors: Javaid Arshad, Plainfield, IL (US); John Haupt, Shippensburg, PA (US); Jenny Elfsberg, Strängnäs (SE)

(73) Assignee: Volvo Construction Equipment AB, Eskilstuna (SE)

( * ) Notice: Subject to any disclaimer, the term of this patent is extended or adjusted under 35 U.S.C. 154(b) by 428 days.

(21) Appl. No.: 16/753,120

(22) PCT Filed: Oct. 5, 2017

(86) PCT No.: PCT/EP2017/075404
§ 371 (c)(1),
(2) Date: Apr. 2, 2020

(87) PCT Pub. No.: WO2019/068333
PCT Pub. Date: Apr. 11, 2019

(65) Prior Publication Data
US 2020/0256039 A1 Aug. 13, 2020

(51) Int. Cl.
*E02F 3/96* (2006.01)
*E02F 9/26* (2006.01)
*E02F 9/20* (2006.01)

(52) U.S. Cl.
CPC ..... *E02F 9/264* (2013.01); *E02F 3/968* (2013.01); *E02F 9/2025* (2013.01)

(58) Field of Classification Search
CPC ..... G05B 19/106; G05B 2219/23425; E02F 9/264; E02F 3/968; E02F 9/2025;
(Continued)

(56) References Cited

U.S. PATENT DOCUMENTS 5,957,213 A * 9/1999 Loraas ..... E02F 3/96 37/302
8,521,371 B2 * 8/2013 Faivre ..... G05B 19/106 701/50

(Continued)

FOREIGN PATENT DOCUMENTS

CN 103297918 A 9/2013
CN 103502537 A1 1/2014

(Continued)

OTHER PUBLICATIONS

Chinese First Office Action dated Jun. 25, 2021 for Chinese Patent Application No. 201780095560.1, 13 pages (including English translation.

(Continued)

*Primary Examiner* — Edwin J Toledo-Duran
(74) *Attorney, Agent, or Firm* — Sage Patent Group

(57) ABSTRACT

A working machine includes an attachment device, and an attachment device carrying equipment enabling detachment and attachment of the attachment device. The working machine further includes a system for monitoring attachment status of the attachment device, the system including: a sensor configuration arranged and configured to indicate the attachment status of the attachment device, and a control unit configured to monitor the sensor configuration to establish the attachment status of the attachment device, and configured to store location data of the attachment device based on the attachment status of the attachment device. An indication that the attachment device is de-attached from the attachment device carrying equipment determines that the location data of the attachment device is stored.

17 Claims, 4 Drawing Sheets

(58) Field of Classification Search
CPC ..... E02F 3/96; E02F 3/963; G06Q 10/0833; G07C 3/00
See application file for complete search history.

(56) References Cited

U.S. PATENT DOCUMENTS

| | | | | |
|---|---|---|---|---|
| 9,938,693 | B1 * | 4/2018 | Reed | G06Q 10/0833 |
| 2004/0227645 | A1 | 11/2004 | Lujan et al. | |
| 2009/0118844 | A1 | 5/2009 | Schmuck et al. | |
| 2012/0004816 | A1 * | 1/2012 | Okamura | F02D 29/04 701/50 |
| 2014/0060953 | A1 * | 3/2014 | Wetterlund | B62D 21/183 180/53.8 |
| 2014/0067215 | A1 * | 3/2014 | Wetterlund | B62D 21/183 701/69 |
| 2014/0212846 | A1 | 7/2014 | Miller et al. | |
| 2014/0240088 | A1 * | 8/2014 | Robinette | G08B 21/0219 340/5.61 |
| 2016/0312432 | A1 | 10/2016 | Wang et al. | |
| 2017/0372534 | A1 * | 12/2017 | Steketee | E02F 9/003 |
| 2018/0040174 | A1 * | 2/2018 | Koshi | E02F 9/26 |
| 2018/0245316 | A1 * | 8/2018 | Forcash | E02F 1/00 |
| 2019/0093321 | A1 * | 3/2019 | Hiekata | E02F 9/265 |
| 2019/0284784 | A1 * | 9/2019 | Darlington | G07C 3/08 |
| 2020/0114909 | A1 * | 4/2020 | Shelton | B60W 30/09 |

FOREIGN PATENT DOCUMENTS

| | | | |
|---|---|---|---|
| DE | 102011002712 | A1 | 7/2012 |
| EP | 0866177 | A2 | 9/1998 |
| EP | 2644561 | A1 | 10/2013 |
| WO | 2012116408 | A1 | 9/2012 |
| WO | 2015179046 | A1 | 11/2015 |
| WO | 2017150134 | A1 | 9/2017 |

OTHER PUBLICATIONS

International Search Report and Written Opinion of the International Searching Authority, PCT/EP2017/075404, dated Jun. 7, 2018, 13 pages.

Chinese Notice of Grant dated Nov. 2, 2022 for Chinese Patent Application No. 201780095560.1, 8 page (including English summary).

* cited by examiner

WORKING MACHINE HAVING AN ATTACHMENT DEVICE AND A SYSTEM FOR MONITORING ATTACHMENT STATUS OF AN ATTACHMENT DEVICE

CROSS REFERENCE TO RELATED APPLICATIONS

This application is a 35 U.S.C. § 371 national stage application of PCT International Application No. PCT/EP2017/075404 filed on Oct. 5, 2017, the disclosure and content of which is incorporated by reference herein in its entirety.

TECHNICAL FIELD

The invention relates to a working machine having an attachment device, and an attachment device carrying equipment. The invention further relates to a system for monitoring attachment status of an attachment device to an attachment device carrying equipment of a working machine. The invention further relates to a method for locating a lost attachment device of a working machine, and to a computer program comprising program code means for performing the steps of such method.

BACKGROUND

In the field of construction equipment there are a number of different working machines used to move, haul or dig material such as soil, gravel, rocks etcetera.

In connection with the work carried out by working machine, an attachment device may be attached to an attachment device carrying equipment in order to perform the associated work. For example, for a wheel loader intended to pick up and transport loads, the wheel loader may comprise a loading bucket as the attachment device. In another example, the working machine may be an excavator used for moving loads from one position to another, and the attachment device may be an excavator digging bucket. Typically, the attachment device of the working machine may be de-attached from the attachment device carrying equipment to which is to connected, and another type of attachment device may be coupled to the working machine, and the attachment device carrying equipment. In the load wheeler example, the bucket may be de-attached, and for example a couple of forks may instead be attached to the attachment device carrying equipment of the wheel loader, whereby the wheel loader can perform other types of works such as e.g. moving and lifting goods.

For a working machine working at a construction site, or another working site, misplacement of the attachment device may be related to time-consuming searching and localization of the attachment device, as the construction site, or a working site, may extend over several acres. US 2004/0227645 relates to a motion detector and signal transmitter for use in an apparatus for detecting and reporting dislocation of heavy mining equipment. The motion detector has an electromagnetic transducer that detects relative motion between two metal parts that are normally held together in surface engagement (according to the Abstract of US 2004/0227645).

However, there is still a need in the industry to improve the time it takes to locate a misplaced attachment device.

SUMMARY

In view of the above-mentioned and other drawbacks of the prior art, the object of the present inventive concept is to provide a working machine having an attachment device and an attachment device carrying equipment, and to provide a system for monitoring attachment status of an attachment device to an attachment device carrying equipment of a working machine, which at least alleviates above mentioned problems.

The invention is based on the inventors' realization that when the attachment device, being e.g. a shovel or a bucket or another ground engaging tool component, of a working machine is de-attached and left behind in a working site, the location of the de-attachment, and thus the location of the attachment device which has been left behind, may be stored for easy localization of the attachment device later on. Thus, the attachment device may easily be localized and picked up at a time subsequent to the de-attachment, either by the working machine or another vehicle. Thus cumbersome and time-consuming searching for the attachment device in the working site can be omitted, or at least reduced to a minimum. Moreover, the invention provides for the possibility of not having a locator, such as e.g. a GPS module, arranged on the attachment device, which locator can be damaged and/or may require electricity to function.

According to at least a first aspect of the invention, the object is achieved by a working machine according to claim 1. More specifically, the invention relates to a working machine having an attachment device, and an attachment device carrying equipment enabling detachment and attachment of said attachment device, said working machine further comprises a system for monitoring attachment status of said attachment device to said attachment device carrying equipment, said system comprising:

- a sensor configuration arranged and configured to indicate the attachment status of said attachment device,
- a control unit configured to monitor said sensor configuration in order to establish the attachment status of said attachment device, and configured to store location data of the attachment device based on the attachment status of said attachment device, wherein an indication that the attachment device is de-attached from said attachment device carrying equipment determines that the location data of the attachment device is stored.

By the provision of a working machine having a sensor configuration and a control unit which are capable of monitoring the attachment status of the attachment device, and to store a location of any de-attachment of the attachment device, a simple but yet effective method for later localization of the de-attached attachment device is provided. Thus, as the attachment device is de-attached from the attachment carrying equipment of the working machine, the location of the de-attachment, and thus the location of the placed attachment device, is stored as location data for later use when e.g. attachment device needs to be located. Thus, it should be understood that the stored location of the de-attachment may be used subsequent to the de-attachment in order to localize the de-attached attachment device. As the working site, or construction site, often extends over a vast area, the location of the de-attached attachment device facilitates and accelerates the finding of a de-attached attachment device.

According to one embodiment, the location functionality of the de-attachment of the attachment device is carried out by using a localization means such as e.g. a GPS (i.e. the location data may comprise GPS coordinates). Thus, the control unit may be configured to initiate the localization means to register its localization, i.e. for the example of using a GPS, the GPS coordinates is registered, upon establishment of a de-attached status of the attachment device. According to one embodiment, the working machine comprises said localization means, such as e.g. a GPS, connected to the control unit. According to one alternative embodiment, the localization means comprises a map, or a local coordinate system, over the working site or the construction site, and is configured with the functionality of storing the local coordinates upon establishment of a de-attached status of the attachment device (i.e. the location data may comprise local coordinates). Thus, the local coordinates of the de-attachment of the attachment device may be stored.

According to one embodiment, the sensor configuration comprises a sensor for sensing the presence of the attachment device in the working machine, e.g. by measuring the distance between the attachment device and another portion of the working machine (e.g. the distance between the attachment device carrying equipment and the attachment device). For example, the sensor may be an optical sensor. More specifically, and according to one example embodiment, the sensor configuration comprises a transmitting and receiving sensor configuration. The transmitting and receiving sensor configuration may comprise a transmitting device and a receiving device, or a transceiver, e.g. arranged on the attachment device carrying equipment. Hereby, the transmitting device, which is configured to transmit a signal (e.g. an optical signal or an audio based signal), may be arranged to transmit the signal from e.g. the attachment device carrying equipment, towards the attachment device. For cases in which the attachment device is attached to the attachment device carrying equipment (i.e. an attached status of the attachment device), the transmitting device is arranged such that the emitted signal is reflected by the attachment device and towards the receiving device, preferably also arranged on the attachment device carrying equipment. Thus, when the attachment device is attached to the attachment device carrying equipment, the receiving device will receive a reflected signal originating from the transmitting device, which will indicate an attached status of the attachment device. Moreover, when the attachment device is de-attached from the attachment device carrying equipment, the attachment device will no longer be able to reflect the transmitted signal from the transmitting device and thus, the receiving device will not receive the reflected signal, and the sensor configuration will thus be indicating a de-attached status. In other words, based on the transmitted and received signal, the sensor configuration can indicate the attachment status of the attachment device. According to one alternative embodiment, the receiving device is arranged on the attachment equipment, and is thus configured for receiving a transmitted signal (directly) from the transmitting device, when the attachment device is attached to the attachment device carrying equipment (e.g. without having the transmitted signal reflected on the attachment device).

According to one embodiment, the sensor configuration is arranged and configured to indicate the attachment status of the attachment device by providing an input signal, and/or lack of an input signal, to the control unit. For example, for the attached status of the attachment device, the sensor configuration may transmit an input signal to the control unit, and for the de-attached status of the attachment device, the sensor configuration does not transmit an input signal to the control unit (which control unit is programmed to establish that the attachment device is attached to the attachment device carrying equipment when it receives an input signal from the sensor configuration, and programmed to establish that the attachment device is de-attached from the attachment device carrying equipment when it does not receive an input signal from the sensor configuration).

It should be understood that the attachment status may be indicating an attached status of said attachment device, which is representative of a condition in which the attachment device is attached to the attachment carrying equipment, and may be indicating a de-attached status of said attachment device, which is representative of a condition in which the attachment device is de-attached from the attachment carrying equipment. Stated differently, said attachment status indicates an attached state based on that said attachment device is attached to said attachment device carrying equipment, and a de-attached state based on that said attachment device is de-attached from said attachment device carrying equipment.

The control unit is configured to monitor said sensor configuration and the attachment status of the attachment device. This may e.g. be carried out by that the control unit interprets a signal (or lack of a signal) from the sensor configuration as previously described. As soon as the sensor configuration indicates a de-attached status, the control unit establishes that the attachment device has been de-attached from the attachment device carrying equipment, and the location of the de-attached status is stored. It should be noted that the control unit needs not to store the location data itself, but that it may simply initiate the location storing functionality, and that the location data itself (e.g. coordinates, such as GPS coordinates) is stored elsewhere in e.g. a memory connected to the control unit, or that the location data is sent to a remote memory such as e.g. a cloud server or a mobile data storing unit. Stated differently, the control unit may comprise an attachment device locating functionality configured to receive said stored location data indicating where the attachment device was de-attached from said attachment device carrying equipment, and configured to transmit the stored location data (e.g. position coordinates) in order to locate said attachment device.

According to one embodiment, the control unit is arranged and configured to store location data of the attachment device upon a status change of the attachment status from attached status to de-attached status.

It should be understood that the attachment device carrying equipment may be interpreted as the equipment of the working machine intended for carrying and/or coupling the attachment device. Hence, according to one embodiment, the attachment device carrying equipment comprises at least one arm, preferably hydraulic driven by hydraulic actuators. Additionally or alternatively, the attachment device carrying equipment comprises a coupler or a coupling arrangement configured for a releaseably connection to a coupling unit of the attachment device.

According to one embodiment, said control unit is configured to record when the attachment status of said attachment device indicates that the attachment device is de-attached from said attachment device carrying equipment by a time-stamp.

Hereby, also the time data of when the attachment device was de-attached from the attachment device carrying equipment may be stored. Thus, during subsequent localization of the attachment device, both the location data and time data of de-attachment of the attachment device may be provided. Hence, information related to where, and for how long, an attachment device has been de-attached can be used. Alternatively or additionally, the control unit may be configured to overwrite a previous recorded location, or location data, based on that the control unit subsequent to receiving a first indication of a de-attached status, receives a second indication of a de-attached status. Thus, the most recent location data of the attachment device may be stored without the need of time-stamping the de-attachment of the attachment device from the attachment device carrying equipment.

According to one embodiment, said system, e.g. said control unit of said system, is configured to record the total time the sensor configuration indicates that the attachment device is attached to said attachment device carrying equipment in order to estimate the condition of the attachment device.

By time-stamping when the attachment device is de-attached from said attachment device carrying equipment, two subsequent recorded de-attachments can be used to calculate to intermediate time which is representing an attached status of the attachment device. Additionality, or alternatively, said control unit may be configured to record when the attachment status of said attachment device indicates that the attachment device is attached to said attachment device carrying equipment by a time-stamp. Thus, the total time for when the attachment device is attached to the attachment device carrying equipment may be calculated directly.

The condition of the attachment device may be based on an empirical method, in which e.g. a known constant of the wear per time unit is multiplied with the total time of the attached status of the attachment device.

According to one embodiment, said sensor configuration comprises a first sensor element arranged on said attachment device, and comprises a second sensor element arranged on the attachment device carrying equipment, wherein said first and second sensor elements form a sensor pair arranged and configured to indicate the attachment status of said attachment device.

Hereby, the second sensor element may recognize e.g. the presence of, or position in relation to, or distance to, the first sensor element (and/or vice versa) of the same sensor pair, as long as the first sensor element is within a predetermined distance from the second sensor element. Such predetermined distance is preferably adapted to represent a condition in which the attachment device is attached to the attachment device carrying equipment. When the first sensor element is moved out of, or is positioned outside of, the predetermined distance from the corresponding second sensor element, the sensor configuration indicates a de-attached status of the attachment device. Thus, the predetermined distance is also adapted not to represent a condition in which the attachment device is de-attached from the attachment device carrying equipment.

According to one embodiment, one of said first sensor element and said second sensor element of said sensor pair comprises a passive sensor, and wherein the other one of said first sensor element and said second sensor element of said sensor pair comprises an active sensor.

Hereby, an energy efficient sensor configuration is provided. The sensor pair may be referred to a passive-active sensor pair.

According to one embodiment, said first sensor element comprises a magnetic element, and said second sensor element comprises a magnetically actuable switch, such as e.g. a Hall-effect switch.

Hereby, a simple and cheap, but yet effective sensor configuration is provided. Thus, as long as the magnetic element of the first sensor element is close enough to active the magnetically actuable switch of the second element (i.e. the first sensor element is within the predetermined distance of the second sensor element described previously), the sensor configuration will indicate attached status of the attachment device (e.g. by a lack of an input signal to the control unit). When the first element is moved far away from the magnetically actuable switch (i.e. the first sensor element is not within the predetermined distance of the second sensor element described previously), there will no longer be a magnet close enough to activate the magnetically actuable switch, so it will close, and the sensor configuration will indicate de-attached status of the attachment deice (e.g. by transmitting an input signal to the control unit).

Stated differently, and according to one embodiment, when said attachment device is attached to said attachment device carrying equipment, said magnetically actuable switch is arranged on said attachment device carrying equipment in close proximity to said magnetic element on said attachment device.

According to one embodiment, said sensor configuration comprises:

- a plurality of first sensor elements comprising said first sensor element, said plurality of first sensor element being arranged on said attachment device, and
- a plurality of corresponding second sensor elements comprising said second sensor element, said plurality of corresponding second sensor elements being arranged on the attachment device carrying equipment such that each one of said first sensor element is paired with a corresponding second sensor element in a sensor pair,
- wherein the number sensor pairs is unique for a specific attachment, and wherein said control unit is configured to recognize and indicate the specific attachment device based on the number of sensor pairs.

Hereby, the same equipment used for establishing a de-attached status of the attachment device, can be used for attachment device recognition, i.e. to recognize and identify the type of attachment device.

Thus, the number of sensor pairs may be unique for a specific attachment device, and the control unit may be configured to recognize and identify or indicate the specific attachment device based on the number of sensor pairs. Very simplified, and according to an example, two sensor pairs may for example indicate that the attachment device is a bucket, while three sensor pairs (not shown) may indicate that the attachment device is a drill.

Moreover, by having at least two sensor pairs, i.e. a first sensor pair and a second sensor pair, the control unit may be configured to indicate an erroneous attachment of the attachment device to the attachment device carrying equipment, if it receives conflicting information from the two different sensor pairs, e.g. that the first sensor pair indicates an attached status and the second sensor pair indicates a de-attached status of the attachment device. Thus, the same equipment used for establishing a de-attached status of the attachment device, can be used for error detecting an erroneous attachment of the attachment device.

According to at least a second aspect of the invention, the object is achieved by a system according to claim 8. More specifically, the invention relates to a system for monitoring attachment status of an attachment device to an attachment device carrying equipment of a working machine, said system comprising:

- a sensor configuration arrangeable on the working machine and being configured to indicate the attachment status of said attachment device,
- a control unit configured to monitor said sensor configuration in order to determine the attachment status of said attachment device, and configured to store location data of the attachment device based on the attachment status of said attachment device, wherein an indication that the attachment device is de-attached from said attachment device carrying equipment determines that the location data of the attachment device is stored.

Effects and features of this second aspect of the present invention are largely analogous to those described above in connection with the first aspect of the inventive concept. Embodiments mentioned in relation to the first aspect of the present invention are largely compatible with the second aspect of the invention, of which some embodiments are explicitly mentioned in the following. In other words a working machine as described with any of the embodiments of the first aspect of the invention is applicable to the system described in relation to the second aspect of the invention.

In other words, the control unit is configured to store location data of the attachment device based on the de-attached status of said attachment device to said attachment device carrying equipment.

For example and according to one embodiment, said control unit may be configured to record when the attachment status of said attachment device indicates that the attachment device is de-attached from said attachment device carrying equipment by a time-stamp.

For example and according to one embodiment, said system, e.g. said control unit of said system, is configured to record the total time of when the sensor configuration indicates that the attachment device is attached to said attachment device carrying equipment in order to estimate the condition of the attachment device.

For example and according to one embodiment, said sensor configuration comprises a first sensor element arrangeable on said attachment device, and comprises a second sensor element arrangeable on the attachment device carrying equipment, wherein said first and second sensor elements form a sensor pair arranged and configured to indicate the attachment status of said attachment device.

For example and according to one embodiment, one of said first sensor element and said second sensor element of said sensor pair comprises a passive sensor, and wherein the other one of said first sensor element and said second sensor element of said sensor pair comprises an active sensor.

For example and according to one embodiment, said first sensor element comprises a magnetic element, and said second sensor element comprises a magnetically actuable switch, such as e.g. a Hall-effect switch.

According to at least a third aspect of the present invention, the object is achieved by a method according to claim 14. More specifically, the invention relates to a method for locating a lost attachment device of a working machine, said method comprising the steps of:

securing and storing location data of de-attachment of the attachment device from said working machine using a control unit configured to monitor attachment status of said attachment device;

accessing said location data of said de-attachment;

transmitting the location data (such as e.g. position coordinates) of said de-attachment in order to locate said attachment device.

Effects and features of this third aspect of the present invention are largely analogous to those described above in connection with the first aspect and/or the second aspect of the inventive concept. Embodiments mentioned in relation to the first aspect and/or the second aspect of the present invention are largely compatible with the third aspect of the invention. In other words a working machine as described with any of the embodiments of the first aspect and/or second aspect of the invention is applicable in the method described in relation to the third aspect of the invention.

According to at least a fourth aspect of the invention, the object is achieved by a computer program according to claim 15. More specifically, the invention relates to a computer program comprising program code means for performing the steps of the method described with third aspect of the invention, when said program is run on a computer.

According to at least a fifth aspect of the invention, the invention relates to a computer readable medium carrying a computer program comprising program code means for performing the steps of the method described with reference to the third aspect of the invention, when said program product is run on a computer.

Effects and features of the fourth and fifth aspects of the present invention are largely analogous to those described above in connection with the first to third aspects of the inventive concept. Embodiments mentioned in relation to the first to third aspects of the present invention are largely compatible with the fourth and fifth aspects of the invention. In other words a working machine as described with any of the embodiments of the first to third aspects of the invention is applicable in the method described in relation to the fourth or fifth aspects of the invention.

Further advantages and advantageous features of the invention are disclosed in the following description and in the dependent claims.

BRIEF DESCRIPTION OF THE DRAWINGS

With reference to the appended drawings, below follows a more detailed description of embodiments of the invention cited as examples.

In the drawings.

DETAILED DESCRIPTION OF EXAMPLE EMBODIMENTS OF THE INVENTION

Figure 1:
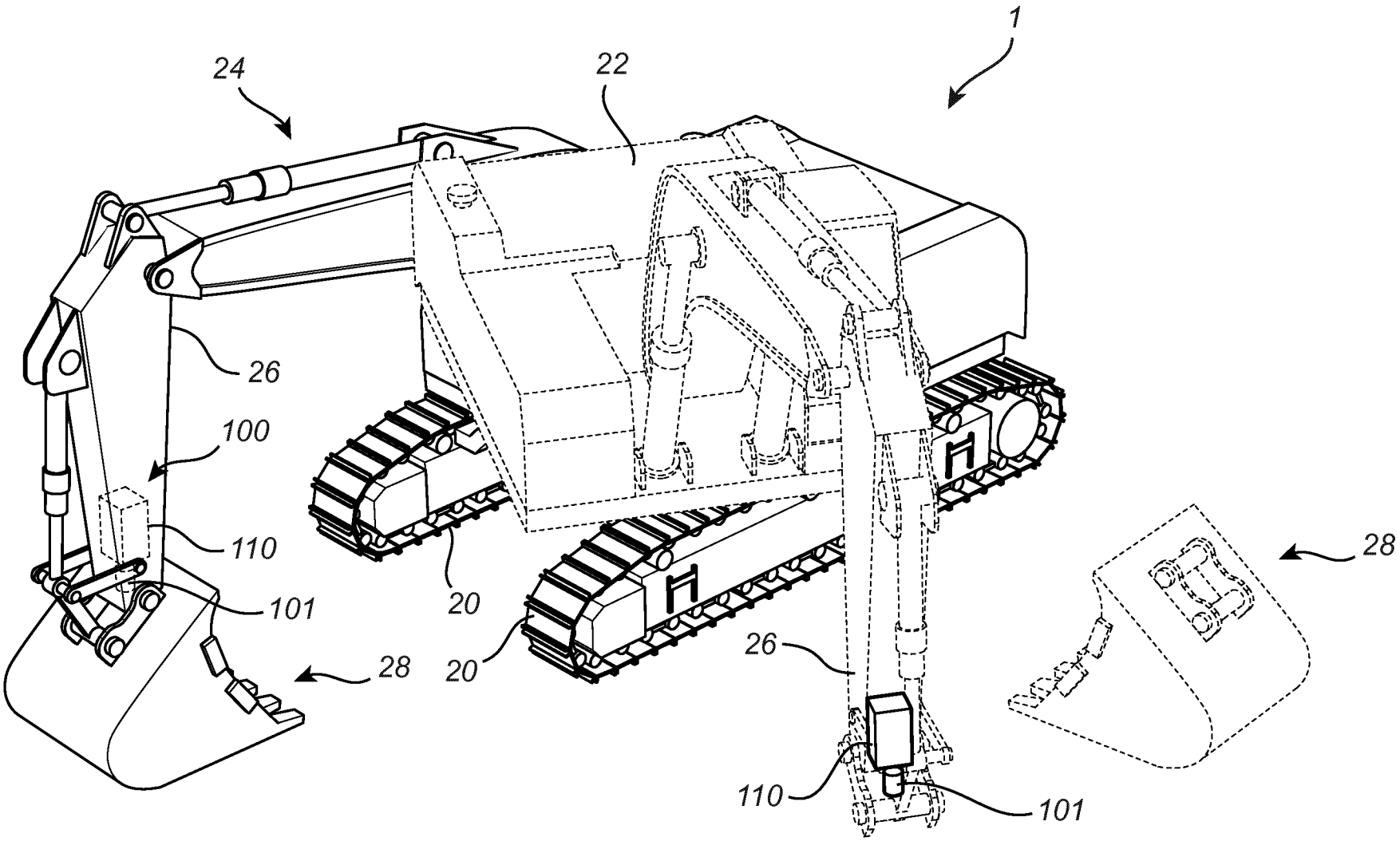
FIG. 1 is a perspective view of a working machine according to one embodiment of the invention.

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled addressee. Like reference characters refer to like elements throughout.

In the following, a working machine 1 is described. The inventive concept is applicable on any working machines comprising an attachment or attachment device such as e.g. a bucket, a blade, a pair of forks, grapples or the like, within the fields of industrial construction machines or construction equipment. Although the invention will be described with respect to an excavator, the invention is not restricted to this particular machine, but may also be used in other working machines such as e.g. haulers, articulated haulers, dumpers, backhoe loaders and wheel loaders.

As seen in FIG. 1 the working machine 1 comprises an attachment device 28, and an attachment device carrying equipment 26 enabling detachment and attachment of the attachment device 28. In the embodiment shown in FIG. 1, where the working machine is an excavator 1, the excavator comprises a pair of crawlers 20, a swing member 22, here being the part of the excavator 1 comprising e.g. the cab, the engine, the motor etc., a boom 24, here being the long reach boom 24 of the excavator 1, an arm 26, here being the dipper 26 of the excavator 1, and an equipment for handling objects 28, here being bucket 28. Thus the arm 26 of the excavator 1 is in FIG. 1 embodied as the attachment device carrying equipment 26, and the bucket is in FIG. 1 embodied as the attachment device 28. Typically some type of coupling arrangement is present between the attachment device carrying equipment 26 and the attachment device 28, wherein the coupling arrangement enables attachment and de-attachment of the attachment device 28. Thus, both the attachment device 28 and the attachment device carrying equipment 26 are parts of the working machine 1. It should be understood that the attachment device carrying equipment 26 in the embodiment shown in FIG. 1, comprises the arm 26 or dipper 26 of the working machine 1, but that it might according to another embodiment be referring to the coupling arrangement or coupling device to which the attachment device 28 couples to when being attached to the remaining parts of the working machine 1.

Figure 2:
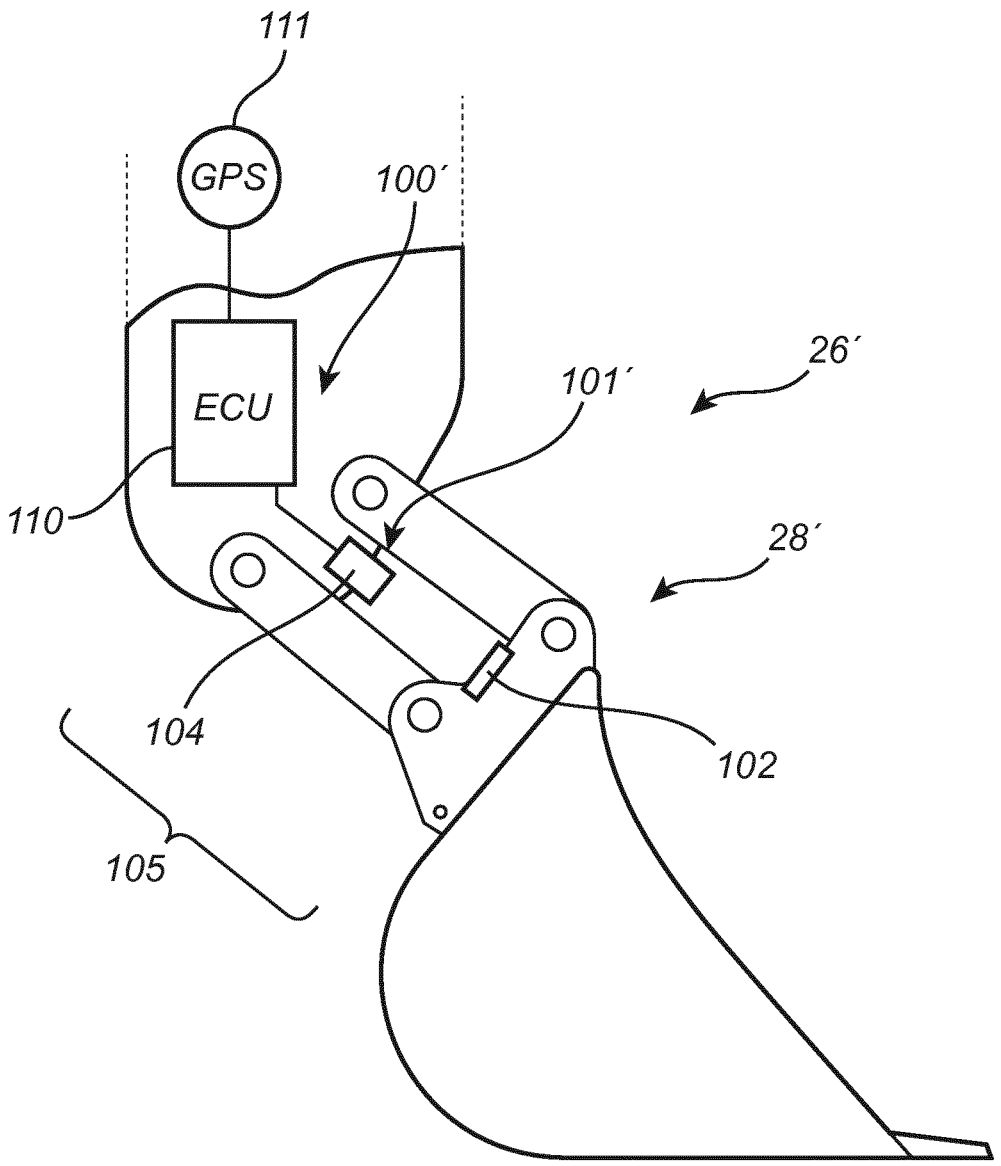
FIG. 2 is a detailed side view of an attachment device and at least a part of an attachment device carrying equipment of a working machine, and a system for monitoring attachment status of the attachment device to the attachment device carrying equipment, according to at least one embodiment of the invention.
Figure 3:
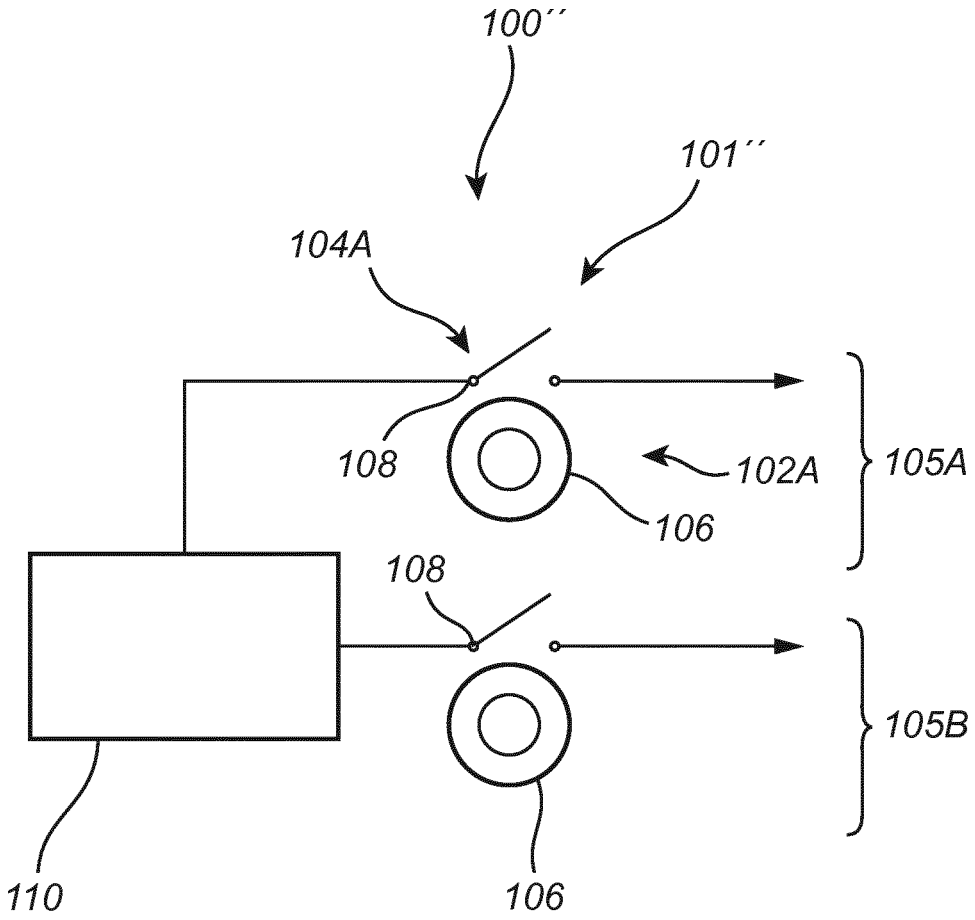
FIG. 3 schematically shows a system for monitoring attachment status of the attachment device to the attachment device carrying equipment, according to at least one embodiment of the invention.

As also shown schematically in FIG. 1, but which is shown in greater detail in FIG. 2 and FIG. 3, the working machine 1 further comprises a system 100, 101' for monitoring attachment status of the attachment device 28 to the attachment device carrying equipment 26. The system 100 comprises:

- a sensor configuration 101 arranged and configured to indicate the attachment status of the attachment device 28,
- a control unit 110 configured to monitor the sensor configuration 101 in order to determine the attachment status of the attachment device 28, and configured to store location data of the attachment device 28 based on the attachment status of the attachment device 28, wherein an indication that the attachment device 28 is de-attached from the attachment device carrying equipment 26 determines that the location data of the attachment device 28 is stored.

Hence, the control unit 110, together with the sensor configuration, is capable of establish at least an attached status of the attachment device 28 in which the attachment device 28 is attached to the attachment device carrying equipment 26, and a de-attached status of the attachment device 28 in which the attachment device 28 is de-attached from the attachment device carrying equipment 26.

In FIG. 1, on the left hand side, the attachment device carrying equipment 26 is shown as being attached to the attachment device 28. Thus, the sensor configuration 101 indicates an attached status of the attachment device 28, and the control unit 110 receives such indication (typically an input signal or a lack of an input signal) from the sensor configuration 101. Hereby, the control unit 110 can establish that the attachment device 28 is attached to the attachment device carrying equipment 26. On the other hand, in FIG. 1 on the right hand side, the attachment device 28 is shown as being de-attached from the attachment device carrying equipment 26. Thus, the sensor configuration 101 indicates a de-attached status of the attachment device 28, and the control unit 110 receives such indication (typically an input signal or a lack of an input signal) from the sensor configuration 101. Hereby, the control unit 110 can establish that the attachment device 28 is de-attached to the attachment device carrying equipment 26, and initiate the process of storing the location of where the attachment device 28 was de-attached from the attachment device carrying equipment 26. Thus, it should be understood that the process of storing the location typically is carried out simultaneously with, or shortly directly after, the status of the attachment device 28 is changed from an attached status to a de-attached status.

The sensor configuration 101 may according to at least one embodiment comprise a transmitting and receiving sensor configuration. The transmitting and receiving sensor configuration may e.g. be arranged on the attachment device carrying equipment 26. For example, the sensor configuration 101 may comprise a transmitting device configured to transmit a signal (e.g. an optical signal or an audio based signal) from the attachment device carrying equipment 26 towards the attachment device 28, which, for when the attachment device 28 is attached to the attachment device carrying equipment 26, reflects the transmitted signal back towards a receiving device, also arranged on the attachment device carrying equipment 26, of the transmitting and receiving sensor configuration. Thus, when the attachment device 28 is attached to the attachment device carrying equipment 26, the receiving device will receive a reflected signal originating from the transmitting device, which will indicate an attached status. Moreover, when the attachment device 28 is de-attached from the attachment device carrying equipment 26, the attachment device 28 is unable to reflect the transmitted signal from the transmitting device and the receiving device will not receive a reflected signal, and will thus be indicating a de-attached status. Thus, based on the transmitted and received signal, the sensor configuration can indicate the attachment status of the attachment device. According to one alternative embodiment, the receiving device is arranged on the attachment equipment 28, and is thus configured for receiving a transmitted signal from the transmitting device, when the attachment device 28 is attached to the attachment device carrying equipment 26 (e.g. without that the transmitted signal is reflected on the attachment device 28).

The control unit 110 is typically configured to record when the attachment status of the attachment device 28 indicates that the attachment device 28 is de-attached from the attachment device carrying equipment 26 by a time-stamp. Thus, for the example embodiment in which the sensor configuration comprises a transmitting and receiving configuration, once the receiving device no longer receives a signal from the transmitting device, the control unit 110 establish a de-attached status of the attachment device 28 and records the time of the de-attachment (i.e. time-stamps the de-attachment of the attachment device 28).

Based on the capability of the control unit 110 to time-stamp, the control unit may alternatively or additionality, record the total time the sensor configuration 101 indicates that the attachment device 28 is attached to the attachment device carrying equipment 26 in order to estimate the condition of the attachment device. For example, the control unit 110 may time-stamp a first condition change from the de-attached status to the attached status, and time-stamp a second subsequently occurring condition change from the attached status to the de-attached status, and subsequently determined the total time of when the attachment device 28 has been attached to the attachment device carrying equipment 26. Hence, based on known predications of wear per time unit for the attachment device 28, the total wear, and thus the condition, of the attachment device 28 can be estimated.

Turning to FIG. 2, being a side view of an attachment device 28' and at least a part of an attachment device carrying equipment 26'. The attachment device 28' and the attachment device carrying equipment 26' may for example correspond to the attachment device 28 and the attachment device carrying equipment 26 of the excavator 1 in FIG. 1, but may as well be parts of another working machine such as e.g. a wheel loader.

In FIG. 2, a system 100' for monitoring the attachment status of the attachment device 28' to the attachment device carrying equipment 26' is shown. The system 100' in FIG. 2 is similar to the system 100 of FIG. 1, and comprises e.g. a corresponding control unit 110. Thus, the system 100' in FIG. 2 may replace, or correspond to, the system 100 shown in FIG. 1. The system 100' in FIG. 2 comprises a sensor configuration 101' having a first sensor element 102 arranged on the attachment device 28', and a second sensor element 104 arranged on the attachment device carrying equipment 26', wherein the first and second sensor elements 102, 104 form a sensor pair 105. The sensor pair 105 is arranged and configured to indicate the attachment status of the attachment device 28', similar to that described with reference to FIG. 1.

Hence, the second sensor element 104 may for example recognize the presence or position of the first sensor element 102 (and/or vice versa) as long as the first sensor element 102 is within a predetermined distance from the second sensor element 104, i.e. when the attachment device 28' is attached to the attachment device carrying equipment 26'. If the first sensor element 102 is moved or positioned out of the predetermined distance from the second sensor element 104, i.e. when the attachment device 28' is de-attached from the attachment device carrying equipment 26', the sensor configuration 101' indicates a de-attached status of the attachment device 28'. According to one example embodiment, one of the first sensor element 102 and the second sensor element 104 comprises a passive sensor, and the other one of the first sensor element 102 and the second sensor element 104 comprises an active sensor. Thus, the sensor pair 105 may be comprised of a passive-active sensor pair. The control unit 110 functions similar to the control unit described with reference to FIG. 1, and will thus not be described here in detail again. However, a localization means 111 in the form of a GPS module 111 is schematically illustrated as being connected to the control unit 110 of FIG. 2.

Further, in FIG. 3, an embodiment of the system 100' of FIG. 2 is shown. The system 100" in FIG. 3 comprises a sensor configuration (101") arrangeable on the working machine and being configured to indicate the attachment status of an attachment device to an attachment device carrying equipment of the working machine, The system 100" further comprises a control unit 110 similar to the control unit described with reference to FIG. 1 and FIG. 2, e.g. configured to monitor the sensor configuration 101" in order to determine the attachment status of the attachment device, and configured to store location data of the attachment device based on the attachment status of the attachment device, wherein an indication that the attachment device is de-attached from the attachment device carrying equipment determines that the location data of the attachment device is stored (e.g. using a GPS module 111 as shown in FIG. 2).

The sensor configuration 101" of FIG. 3 comprises a first sensor element 102A arrangeable on the attachment device, and comprises a second sensor element 104A arrangeable on the attachment device carrying equipment, thus forming at least a first sensor pair 105A arranged and configured to indicate the attachment status of the attachment device. In FIG. 3, the first sensor element 102A is a passive sensor element in the form of a magnetic element 102A. Moreover, the second sensor element 104A is an active sensor element comprising a magnetically actuable switch 104A, such as e.g. a Hall-effect switch. Thus, as long as the first sensor element 102A is within a predetermined distance from the second sensor element 104B, the switch is opened/closed, and the control unit 110 can establish that the attachment device is attached to the attachment device carrying equipment. Correspondingly, when the first sensor element 102A is outside of the predetermined distance from the second sensor element 1048, the switch is opened/closed, and the control unit 110 can establish that the attachment device is de-attached from the attachment device carrying equipment.

As also shown in FIG. 3, the sensor configuration 101" may comprise at least a second sensor pair 1058, equal to, or at least very similar to, the first sensor pair 105A, why it is not described here in detail again. Thus, in other words, the sensor configuration 101" may comprises a plurality of first sensor elements 106 arranged or arrangeable on the attachment device, and a plurality of corresponding second sensor elements 108 arranged or arrangeable on the attachment device carrying equipment. Hereby, each one of the first sensor element 102A is paired with a corresponding second sensor element 104A in a sensor pair 105A, 1058. Any one of the sensor pairs 105A, 105B shown in FIG. 3 may be comprised of the sensor pair 105 described with reference to FIG. 2.

The number of sensor pairs 105A, 1058 may be unique for a specific attachment device, and the control unit 110 may be configured to recognize and indicate the specific attachment device based on the number of sensor pairs 105A, 105B. Very simplified, and according to an example, two sensor pairs 105A, 105B may indicate that the attachment device is a bucket, while three sensor pairs (not shown) may indicate that the attachment device is a drill.

Figure 4:
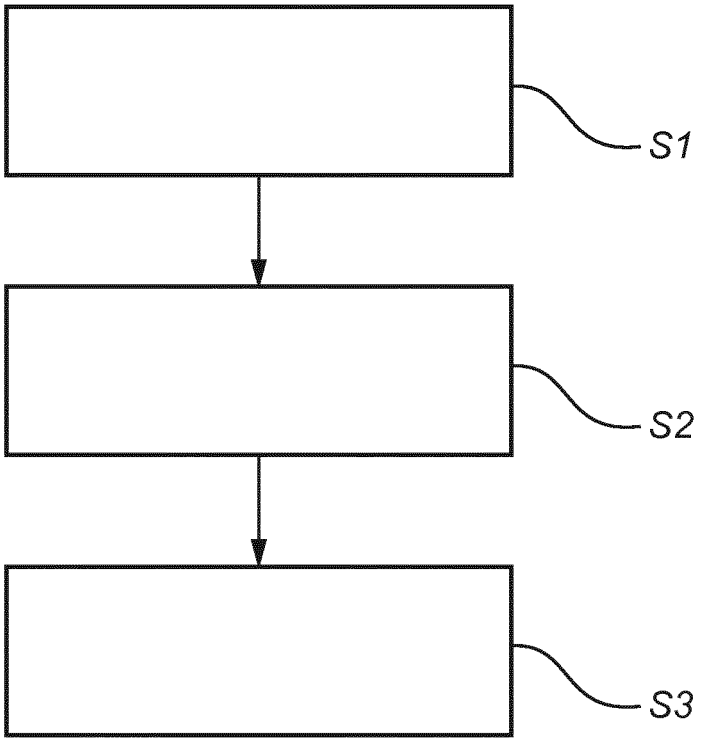
FIG. 4 is a flow chart of the steps in a method for locating a lost attachment device of a working machine according to at least one embodiment of the invention.

Turning to FIG. 4 showing a flow chart of the steps in a method for locating a lost attachment device of a working machine according to one aspect of the invention. In a first step S1, a location of de-attachment of the attachment device from said working machine is secured and stored using a control unit configured to monitor attachment status of the attachment device. For example, the control unit may be configured to monitor a sensor configuration 101, 101', 101" as described with any one of FIGS. 1-3, in order to establish the attachment status of the attachment device.

In a second step S2, the location of de-attachment is accessed. Hence, the location of the de-attachment determined in the first step S1, is accessed by e.g. the previously described control unit (or another control unit located remote of the working machine).

In a third step, S3, the position coordinates of the location of de-attachment is transmitted in order to locate the attachment device. Hence, the working machine to be coupled to the attachment device may be moved to the location of the de-attachment in order to pick up, and connect to, the attachment device.

The method described with reference to FIG. 4 may e.g. be implemented in a computer program comprising program code means for performing the steps S1-S3, when the computer program is run on a computer. The computer may e.g. be the above mentioned control unit 110.

The control unit 110 may for example be manifested as a general-purpose processor, an application specific processor, a circuit containing processing components, a group of distributed processing components, a group of distributed computers configured for processing, a field programmable gate array (FPGA), etc. The control unit 110 may further include a microprocessor, microcontroller, programmable digital signal processor or another programmable device. The control unit 110 may also, or instead, include an application specific integrated circuit, a programmable gate array or programmable array logic, a programmable logic device, or a digital signal processor. Where the control unit 110 includes a programmable device such as the microprocessor, microcontroller or programmable digital signal processor mentioned above, the processor may further include computer executable code that controls operation of the programmable device.

Correspondingly, the GPS module 111 may for example include a GPS receiver, a microprocessor, microcontroller, programmable digital signal processor or another programmable device. The GPS module 111 may also, or instead, include an application specific integrated circuit, a programmable gate array or programmable array logic, a programmable logic device, or a digital signal processor arranged and configured for digital communication with the control unit 110. Where the control unit 110 includes a programmable device such as the microprocessor, microcontroller or programmable digital signal processor mentioned above, the GPS module may simply comprise a GPS receiver and circuits for digital communication with the control unit 110.

The processor (of the control unit 110 and/or the GPS module 111) may be or include any number of hardware components for conducting data or signal processing or for executing computer code stored in memory. The memory may be one or more devices for storing data and/or computer code for completing or facilitating the various methods described in the present description. The memory may include volatile memory or non-volatile memory. The memory may include database components, object code components, script components, or any other type of information structure for supporting the various activities of the present description. According to an exemplary embodiment, any distributed or local memory device may be utilized with the systems and methods of this description. According to an exemplary embodiment the memory is communicably connected to the processor (e.g., via a circuit or any other wired, wireless, or network connection) and includes computer code for executing one or more processes described herein.

The control unit 110 is connected to the various described features of the working machine, such as e.g. the sensor configuration 101, 101', 101"", and the GPS module 111, and is configured to control system parameters. Moreover, the control unit 110 may be embodied by one or more control units, where each control unit may be either a general purpose control unit or a dedicated control unit for performing a specific function.

The present disclosure contemplates methods, devices and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor.

By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data that cause a general-purpose computer, special purpose computer, or special purpose processing machines to perform a certain function or group of functions.

Although the figures may show a specific order of method steps, the order of the steps may differ from what is depicted. In addition, two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule-based logic and other logic to accomplish the various connection steps, processing steps, comparison steps and decision steps. Additionally, even though the disclosure has been described with reference to specific exemplifying embodiments thereof, many different alterations, modifications and the like will become apparent for those skilled in the art.

It should be understood that GPS module 111, and/or the control unit 110 may comprise a digital signal processor arranged and configured for digital communication with an off-site server or cloud based server. Thus data may be sent to and from the GPS module 111, and/or the control unit 110.

It is to be understood that the present invention is not limited to the embodiments described above and illustrated in the drawings; rather, the skilled person will recognize that many changes and modifications may be made within the scope of the appended claims. For example, the functions and method steps related to the control unit may be divided by several control units. That it, the control unit as described in relation to the invention may comprise several control sub units performing the related functions and method steps described in the application. Thus, variations to the disclosed embodiments can be understood and effected by the skilled addressee in practicing the claimed disclosure, from a study of the drawings, the disclosure, and the appended claims. Furthermore, in the claims, the word "comprising" does not exclude other elements or steps, and the indefinite article "a" or "an" does not exclude a plurality.

The invention claimed is:

1. A working machine having an attachment device, and an attachment device carrying equipment enabling detachment and attachment of the attachment device, the working machine further comprises a system for monitoring an attachment status of the attachment device to the attachment device carrying equipment, the system comprising:

a sensor configuration arranged and configured to indicate the attachment status of the attachment device, wherein the sensor configuration is mounted on the working machine; and a control unit configured to monitor the sensor configuration in order to determine the attachment status of the attachment device, and configured to store location data of the attachment device based on the attachment status of the attachment device in response to the sensor configuration generating an indication of the attachment of the attachment device from the attachment device carrying equipment, wherein the control unit is mounted on the working machine, wherein the control unit is further configured to store the location data of the attachment device at the time of the de-attachment in response to the indication of the de-attachment of the attachment device from the attachment device carrying equipment, and wherein the indication is generated by the sensor configuration in response to the attachment status of the attachment device being changed from an attached status of being attached to the attachment device carrying equipment to a de-attached status of being de-attached from the attachment device carrying equipment.

2. The working machine according to claim 1, wherein said control unit is configured to record when the attachment status of said attachment device indicates that the attachment device is de-attached from said attachment device carrying equipment by a time-stamp.

3. The working machine according to claim 2, wherein said system is configured to record the total time the sensor configuration indicates that the attachment device is attached to said attachment device carrying equipment in order to estimate the condition of the attachment device.

4. The working machine according to claim 1, wherein said sensor configuration comprises a first sensor element arranged on said attachment device, and comprises a second sensor element arranged on the attachment device carrying equipment, wherein said first and second sensor elements form a sensor pair arranged and configured to indicate the attachment status of said attachment device.

5. The working machine according to claim 4, wherein one of said first sensor element and said second sensor element of said sensor pair comprises a passive sensor, and wherein the other one of said first sensor element and said second sensor element of said sensor pair comprises an active sensor.

6. The working machine according to claim 4, wherein said first sensor element comprises a magnetic element, and wherein said second sensor element comprises a magnetically actuable switch.

7. The working machine according to claim 6, wherein the magnetically actuable switch comprises a Hall-effect switch.

8. The working machine according to claim 4 wherein said sensor configuration comprises:

a plurality of first sensor elements comprising said first sensor element, said plurality of first sensor element being arranged on said attachment device, and a plurality of corresponding second sensor elements comprising said second sensor element, said plurality of corresponding second sensor elements being arranged on the attachment device carrying equipment such that each one of said first sensor element is paired with a corresponding second sensor element in a sensor pair, wherein a number of the sensor pairs is unique for a specific attachment device, and wherein said control unit is configured to recognize and indicate the specific attachment device based on the number of sensor pairs.

9. A system for monitoring an attachment status of an attachment device of a working machine to an attachment device carrying equipment of the working machine, the system comprising:

a sensor configuration arrangeable and mounted on the working machine and being configured to indicate the attachment status of the attachment device;

a control unit configured to monitor the sensor configuration in order to determine the attachment status of the attachment device, and configured to store location data of the attachment device based on the attachment status of the attachment device in response to the sensor configuration generating an indication of de-attachment of the attachment device from the attachment device carrying equipment, wherein the control unit is mounted on the working machine, wherein the control unit is further configured to store the location data of the attachment device at the time of the de-attachment in response to the indication of the de-attachment of the attachment device from the attachment device carrying equipment, and wherein the indication is generated by the sensor configuration in response to the attachment status of the attachment device being changed from an attached status of being attached to the attachment device carrying equipment to a de-attached status of being de-attached from the attachment device carrying equipment.

10. The system according to claim 9, wherein said control unit is configured to record when the attachment status of said attachment device indicates that the attachment device is de-attached from said attachment device carrying equipment by a time-stamp.

11. The system according to claim 10, wherein said system is configured to record the total time of when the sensor configuration indicates that the attachment device is attached to said attachment device carrying equipment in order to estimate the condition of the attachment device.

12. The system according to claim 9, wherein said sensor configuration comprises a first sensor element arrangeable on said attachment device, and comprises a second sensor element arrangeable on the attachment device carrying equipment, wherein said first and second sensor elements form a sensor pair arranged and configured to indicate the attachment status of said attachment device.

13. The system according to claim 12, wherein one of said first sensor element and said second sensor element of said sensor pair comprises a passive sensor, and wherein the other one of said first sensor element and said second sensor element of said sensor pair comprises an active sensor.

14. The system according to claim 9, wherein said first sensor element comprises a magnetic element, and wherein said second sensor element comprises a magnetically actuable switch.

15. The system according to claim 14, wherein the magnetically actuable switch comprises a Hall-effect switch.

16. A method for monitoring an attachment status of an attachment device of a working machine to an attachment device carrying equipment of the working machine, the method comprising:

indicating, by using a sensor configuration, the attachment status of the attachment device, wherein the sensor configuration is mounted on the working machine;

monitoring, by using a control unit, the sensor configuration in order to determine the attachment status of the attachment device;

storing, by using the control unit, location data of the attachment device based on the attachment status of the attachment device in response to the sensor configuration generating an indication of de-attachment of the attachment device from the attachment device carrying equipment, wherein the control unit is mounted on the working machine; and storing, by using the control unit, the location data of the attachment device at the time of the de-attachment in response to the indication of the de-attachment of the attachment device from the attachment device carrying equipment, wherein the indication is generated by the sensor configuration in response to the attachment status of the attachment device being changed from an attached status of being attached to the attachment device carrying equipment to a de-attached status of being de-attached from the attachment device carrying equipment.

17. A computer program comprising a non-transitory storage medium comprising computer-readable program code for performing the method of claim 16, when said computer-readable program code is run on a computer.

* * * * *